United States Patent [19]

Jaakonmäki et al.

[11] Patent Number: 4,494,587

[45] Date of Patent: Jan. 22, 1985

[54] WOOD CHIP SHAVER

[75] Inventors: Matti Jaakonmäki; Pentti Raura, both of Valko, Finland

[73] Assignee: Rauma-Repola Oy Loviisan Tehtaat, Finland

[21] Appl. No.: 456,743

[22] Filed: Jan. 10, 1983

[30] Foreign Application Priority Data

Jan. 12, 1982 [FI] Finland ..... 820098

[51] Int. Cl.[3] ..... B02C 18/00; B27C 1/00

[52] U.S. Cl. ..... 144/162 R; 144/176; 241/95

[58] Field of Search ..... 144/162 R, 163, 176; 241/47, 48, 95, 135, 136, 146, 151, 275, 242.1

[56] References Cited

U.S. PATENT DOCUMENTS

| | | | |
|---|---|---|---|
| 3,738,596 | 6/1973 | Miles | 241/95 |
| 3,807,644 | 4/1974 | Van Ee | 241/95 |
| 3,823,880 | 7/1974 | Urschel | 241/95 |

*Primary Examiner*—W. D. Bray

[57] ABSTRACT

A wood chip shaver, consisting of cutting blades disposed on a circle and of a rotor rotating therewithin and carrying on its circumference vane-shaped chip guide members immediately adjacent to the blades, the members guide and press the chips against the blades. In front of the vane of the chip guide member is provided a guide surface approaching the blades in wedge-shape fashion in the travelling direction of the chips, the chips being carried in between the surface and the blades. With the aid the invention the chips are guided to enter between the chip guide members and the blades, whereby leaf-like chips such as are desired are obtained.

4 Claims, 3 Drawing Figures

WOOD CHIP SHAVER

The present invention concerns a wood chip shaver consisting of cutting blades disposed in a ring and of a rotor rotating therewithin and carrying on its circumference vane-shaped chip guide members immediately adjacent to the blades, said members guiding and urging the chips against the blades.

Chip shavers of this type known in the art present the drawback that the chips tend to roll and bounce in front of the chip guide member, and the desired leaf-type shavings are not obtained. The centrifugal force of the rotor is not sufficient to cause the chips to be urged with force against the blades.

The object of the present invention is to eliminate the drawbacks mentioned above. The shaver of the invention is characterized in that before the vane of the chip guide member is disposed a guide surface, approaching the blades in the travelling direction of the chips in wedge fashion, the chips being carried in between this surface and the blades. By the aid of the invention, the chips which have entered the chip guide member cannot roll and bounce and they are instead better and better directed in between the guiding surface of the chip guide member and the blades, whereby the desired leaf-type chips are produced. The chips are guided to lie on their flat sides, whereby shavings parallel to the grain are obtained as desired. Experiments have shown that the power drawn by the machine is indeed expended towards cutting the wood chips, seeing that the quantity that is cut substantially exceeds that of any means known in the art.

An advantageous embodiment of the invention is characterized in that the chip guide member is inclined forward, that is in the travelling direction, so that the chips are directed in the tapering direction of the wedge. Thus, the chips are even better and more positively directed in between the chip guide member and the blades.

Another embodiment of the invention is characterized in that the chip guide members have been divided into two or more consecutive wedge-shaped guide surfaces. Therefore, the chips are even more uniformly distributed in the space between the chip guide members and the blades.

A third embodiment of the invention is further characterized in that the wedge-shaped guide surfaces are stepwise off-set in the different chip guide members. The cutting forces acting on the blades are in this manner distributed very uniformly on all blades, whereby also the wear of the blades is uniform.

Figure 1:
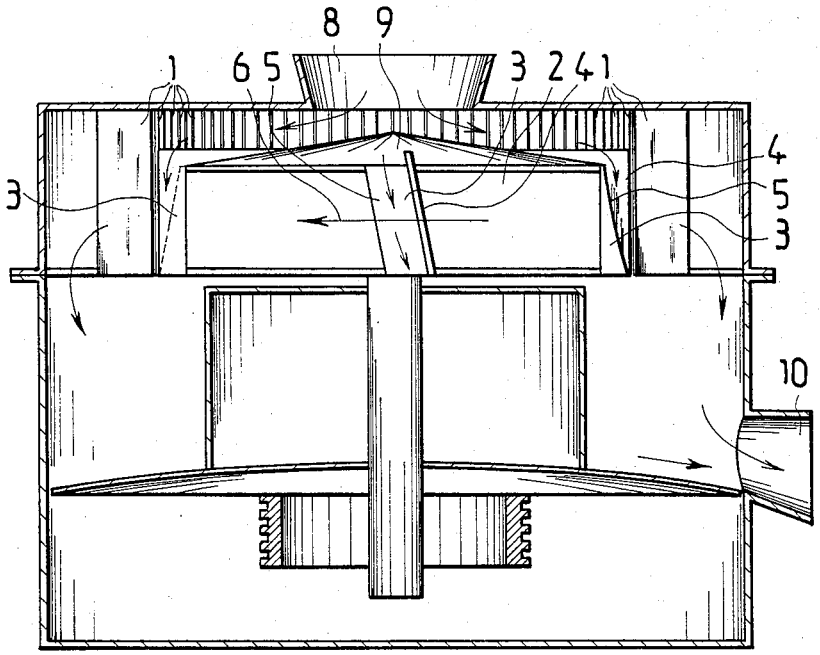

The invention is described in the following by the aid of examples, referring to the drawing attached, wherein FIG. 1 presents a chip shaver according to the invention, in sectional view.

Figure 2:
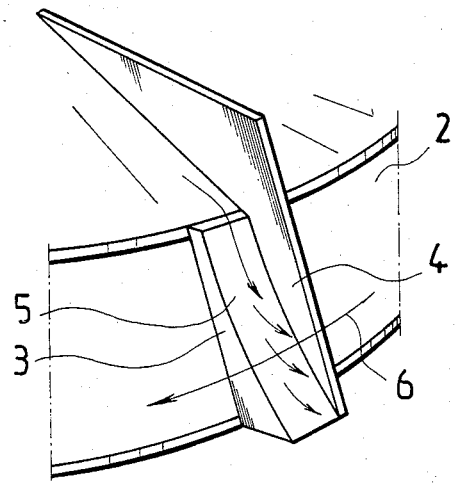

FIG. 2 shows a chip guide member, viewed obliquely from above.

Figure 3:
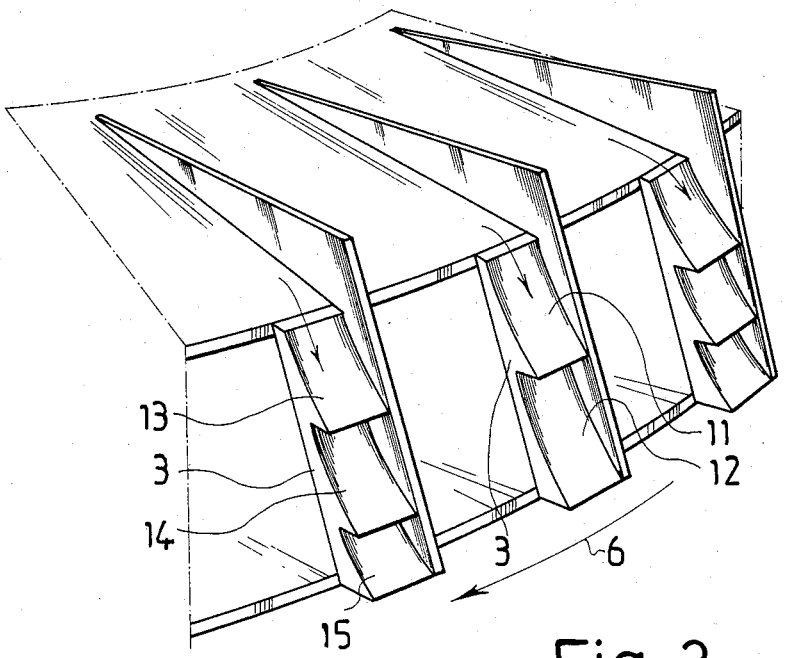

FIG. 3 presents chip guide members according to another embodiment.

The shaver consists of cutting blades 1 disposed in ring form and a rotor 2 rotating therewithin and carrying on its circumference chip guide members 3, which guide and urge the chips against the blades 1. In front of the vane 4 of the chip guide member 3 is placed a wedge-shaped guide surface 5, inclined toward the blades in the direction of travel of the chips, the chips being directed in between this surface of the blades. The chip guide member 3 is inclined forward, that is in the travelling direction. The travelling direction, i.e., the direction of rotation of the rotor 2 is shown with an arrow 6. The chips enter the shaver through the inlet 8 and are directed along with the guide plate 9 on top of the rotor 2, in between the chip guide members 3 and the blades 1. As the chips become wedged between the chip guide members 3 and the blades 1, leaf-type chips such as are desired will be cut from them and these will exit through the exit aperture 10.

The chip guide member 3 of FIG. 3 is provided with a plurality of chip guide surfaces 11,12,13,14 and 15. The chips are thus more uniformly distributed in the space between the chip guide members 3 and the blades 1.

It is obvious to a person skilled in the art that various embodiments of the invention may vary within the scope of the claims stated below.

We claim:

1. A wood chip shaver comprising a rotatable rotor, a plurality of circumferential cutting blades disposed on a circle around the outside of said rotor, a plurality of chip guide members each having a vane thereon carried on the circumference of said rotor, said chip guide members being disposed immediately adjacent to said blades, and shaped for guiding and urging wood chips against the blades, each chip guide member being provided in front of its respective vane with a wedge-shaped guide surface inclined toward the blades in the direction of travel of the chips, whereby the chips are guided in between said surface and the blades.

2. Shaver according to claim 5, wherein each chip guide member is inclined forward in the direction of rotation of the rotor so that the chips are directed in the tapering direction of the wedge.

3. Shaver according to claim 5, wherein the chip guide members are each provided with two or more consecutive wedgeshaped guide surfaces.

4. Shaver according to claim 3, wherein the wedge-shaped guide surfaces are stepwise off-set in different chip guide members.

* * * * *